US006545403B1

(12) United States Patent
Lee

(10) Patent No.: US 6,545,403 B1
(45) Date of Patent: Apr. 8, 2003

(54) COLOR CATHODE RAY TUBE HAVING A DEVELOPED ELECTRON GUN STRUCTURE

(75) Inventor: Joo Il Lee, Chungcheongbuk-do (KR)

(73) Assignee: Orion Electric Co., Ltd., Kyungsangbuk-Do (KR)

( * ) Notice: Subject to any disclaimer, the term of this patent is extended or adjusted under 35 U.S.C. 154(b) by 0 days.

(21) Appl. No.: 09/360,307

(22) Filed: Jul. 23, 1999

(30) Foreign Application Priority Data

Jul. 24, 1998 (KR) ..... 98-29806

(51) Int. Cl.[7] ..... H01J 29/50

(52) U.S. Cl. ..... 313/414; 313/412; 313/441; 313/446

(58) Field of Search ..... 313/414, 409, 313/412, 441, 449, 460, 426, 427, 446, 447

(56) References Cited

U.S. PATENT DOCUMENTS 5,027,043 A * 6/1991 Chen et al. ..... 315/368.11
5,608,284 A * 3/1997 Tojyou et al. ..... 313/414
5,610,481 A * 3/1997 Shirai et al. ..... 315/382
5,739,630 A * 4/1998 Shirai et al. ..... 313/414
6,051,920 A * 4/2000 Kim et al. ..... 313/414
6,094,004 A * 7/2000 Kim et al. ..... 313/414

* cited by examiner

*Primary Examiner*—Vip Patel
*Assistant Examiner*—Kevin Quarterman
(74) *Attorney, Agent, or Firm*—Notaro & Michalos P.C.

(57) ABSTRACT

A color cathode ray tube having an improved electron gun, includes a quadrupole lens consisting of an independent static electrode having a static voltage applied thereto and a dynamic electrode which is disposed opposite to the independent electrode and having a dynamic voltage applied thereto. A dynamic strong quadrupole lens effect is obtained by applying a modulation voltage or parabola voltage to the dynamic electrode. When electron-beam-passing-apertures in electrodes of a main lens are enlarged, each axial distance between the axes of three electron-beam-passing-apertures of the static electrode opposite to the dynamic electrode in the strong quadrupole lens forming electrodes is offset and the sizes of the opposite side electron-beam-passing-apertures are increased by the offset axial distance. Thus, a change in the convergence and spherical abberations resulting when a modulated voltage is applied can be minimized, thereby improving resolution characteristics in the peripheral areas of a screen and convergence characteristics.

1 Claim, 14 Drawing Sheets

CONVENIONAL

PRESENT INVENTION

COLOR CATHODE RAY TUBE HAVING A DEVELOPED ELECTRON GUN STRUCTURE

FIELD AND BACKGROUND OF THE INVENTION

The present invention relates to an improved in-line electron gun structure which has a quadrupole electrode forming an improved quadrupole lens, and more particularly relates to a color cathode ray tube having an improved in-line electron gun structure which can minimize a change in the convergence and spherical aberrations when a modulated voltage is applied, thereby improving resolution characteristics in the peripheral areas of a screen and convergence characteristics.

In general, a deflection yoke system employs a self-convergence deflection yoke in which magnetic fields are non-uniformly transformed into a pin-cushion-type magnetic field in the horizontal deflection and a barrel-type magnetic field in the vertical deflection for removing a dynamic convergence circuit. Thus a spot shape of an electron beam is distorted in the peripheral areas of the screen due to a strong magnetic field of the deflection yoke. This spot shape remarkably changes the resolution at the peripheral areas, so that, in a dynamic focus type, the modulated voltage increased at the peripheral areas is superposed to the focus voltage Vf applied to the convergence electrode, thereby making the spot shape circular in the peripheral areas. In this dynamic focus type, the resolution in the peripheral areas becomes improved, but the convergence action of the main lens to be formed between an anode electrode and a convergence electrode is changed according to the modulation of the focus voltage Vf, thereby causing the problem of the convergence deterioration wherein the spots of opposite side electron beams R and B deviate from the spot of an electron beam G. Meanwhile, to obtain a circular spot shape in the peripheral areas of the screen, several electron gun system are proposed, in which electrodes forming a quadrupole lens are disposed for correcting the transformation of the electron beam in the peripheral areas by using a static electricity.

FIG. 1 is a sectional view of a conventional in-line type electron gun. As shown in FIG. 1, three cathodes 5 are disposed on one horizontal straight line for radiating three electron beams. Above the three cathodes 5, there are provided with a common control electrode 10, a first screen electrode 20, a accelerating electrode 30, a second screen electrode 40, a first focusing static electrode 50 to which a static voltage is applied, a second focusing dynamic electrode 55 to which a dynamic voltage is applied, an anode electrode 60 constituting a main lens and a convergence cup 70. These components are arranged in this order in the dynamic focus type electron gun system, in which electrodes 50 and 55 comprise a quadrupole lens for correcting the spot shape of the electron beam in the peripheral areas of the screen.

FIG. 2 is an exploded perspective view of the electrodes 50 and 55. Used as a quadrupole lens, three electron-beam-passing apertures 50*a*, 50*b* and 50*b* are punched in the electrode 50, on which plate-like protrusions 50*c* and 55*d* are attached. The electrode 55 includes inwardly-bent barriers 55*a*, between which the plate-like protrusions 50*c* and 50*d* are inserted, thereby making a quadrupole lens.

However, in such arrangement it is very difficult to integrate the electrodes and to assemble them due to its construction. And, since a pair of the barriers 55*a* arranged horizontally is common for the three electron beams, the convergence characteristics is deteriorated due to the electric field formed between the central electron-beam-passing aperture 50*a* and the barriers 55*a*. That is, when one quadrupole lens is adapted and the dynamic voltage Vf2 is applied, the intensity of the lens on the vertical axis becomes strong. Thus, the edge of the electron beam on the horizontal axis tends to become enlarged and the core of the electron beam on the horizontal axis tends to become small.

Therefore, the present invention has been made to overcome the above described problems of the prior arts, and accordingly it is an object of the present invention to provide a color cathode ray tube having an improved electron gun, further comprising a quadrupole lens which consists of an independent static electrode to which a static voltage is applied and a dynamic electrode which is disposed opposite to the independent electrode and a dynamic voltage is applied to the dynamic electrode. A strong dynamic quadrupole lens effect is obtained by applying a modulation voltage or parabola voltage to the dynamic electrode.

Also, while enlarging electron-beam-passing apertures in electrodes of a main lens, each axial distance between the axes of three electron-beam-passing apertures of the static electrode opposite to a dynamic electrode in the strong-quadrupole-lens-forming electrodes is offset and the size of the opposite side electron-beam-passing apertures is increased by the offset axial distance. Thus, a change in the convergence and spherical aberrations when a modulated voltage is applied can be minimized, thereby improving resolution characteristics in the peripheral areas of a screen and convergence characteristics.

SUMMARY OF THE INVENTION

The present invention has been made to overcome the above-described problems of the prior art.

Accordingly, it is an object of the present invention to provide a color cathode ray tube having an improved electron gun structure comprising a first electrode, a second electrode, a third electrode, a fourth electrode, an anode electrode and a convergence cup for focusing three electron beams radiated from cathodes arranged in line. Said electron gun further comprises second quadrupole lens-forming electrodes consisting of a second static electrode having a static voltage applied thereto and a second dynamic electrode disposed opposite to the second static electrode and having a dynamic voltage applied thereto; third quadrupole lens forming electrodes consisting of a third static electrode having a static voltage applied thereto, and a third dynamic electrode which is disposed opposite to the third static electrode and a dynamic voltage is applied thereto; and fourth quadrupole lens forming electrodes consisting of a fourth static electrode to which a static voltage is applied, and a fourth dynamic electrode which is disposed opposite to the fourth static electrode and a dynamic voltage applied thereto.

BRIEF DESCRIPTION OF THE DRAWINGS

The above object, and other features and advantages of the present invention will become more apparent by describing in detail preferred embodiments thereof with reference to the attached drawings, in which.

DESCRIPTION OF THE PREFERRED EMBODIMENTS

Hereinafter, several preferred embodiments of the present invention will be described in detail with reference to the accompanying drawings.

Figure 1:
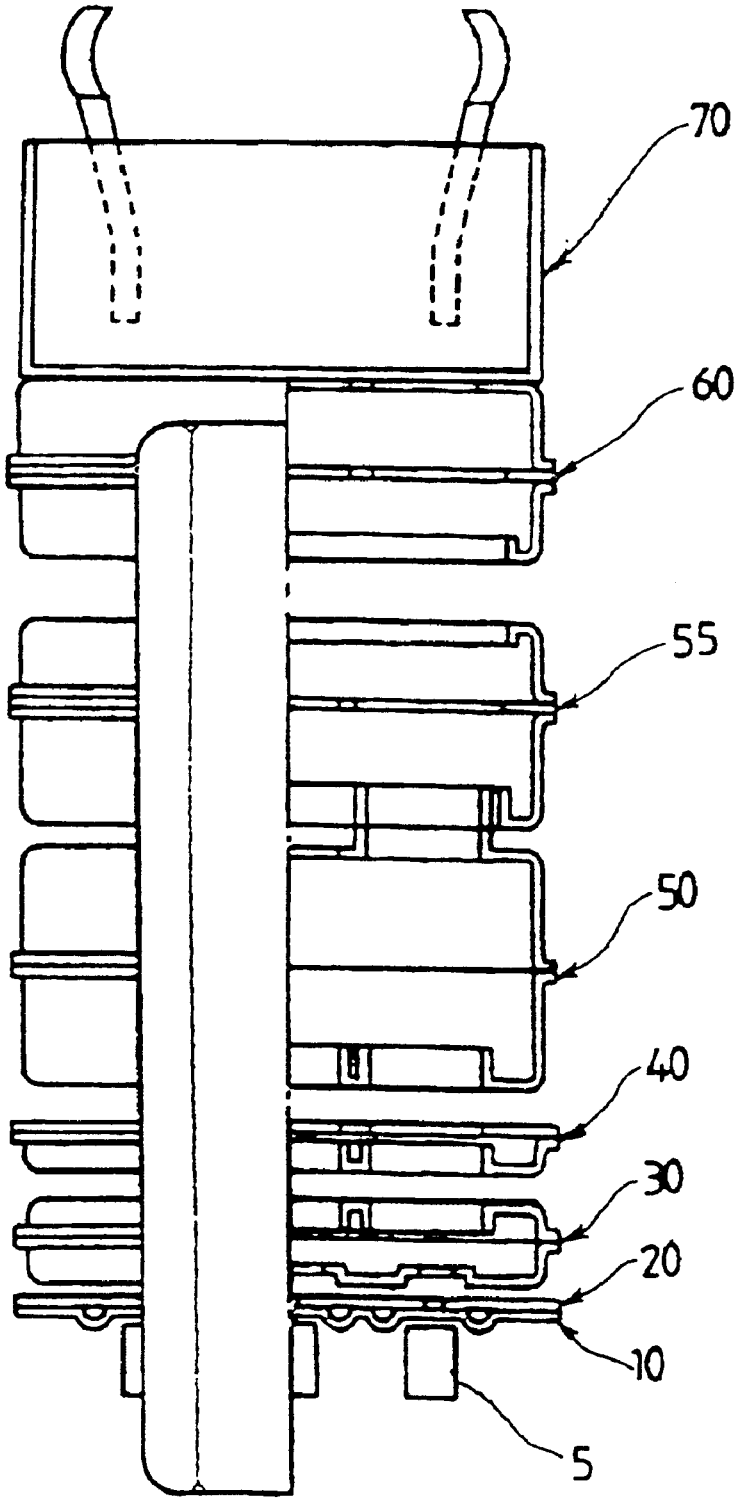
FIG. 1 is a sectional view of the conventional in-line type electron gun for describing its construction and operation.
Figure 2:
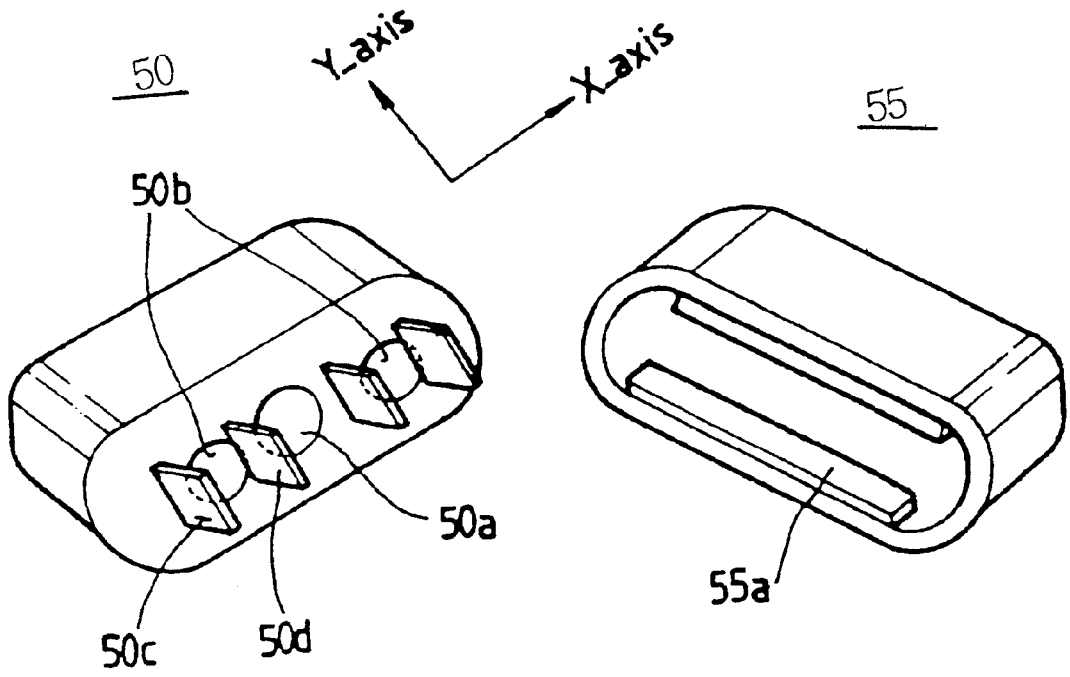
FIG. 2 is an exploded perspective view of some of the conventional quadrupole lens forming electrodes.
Figure 3:
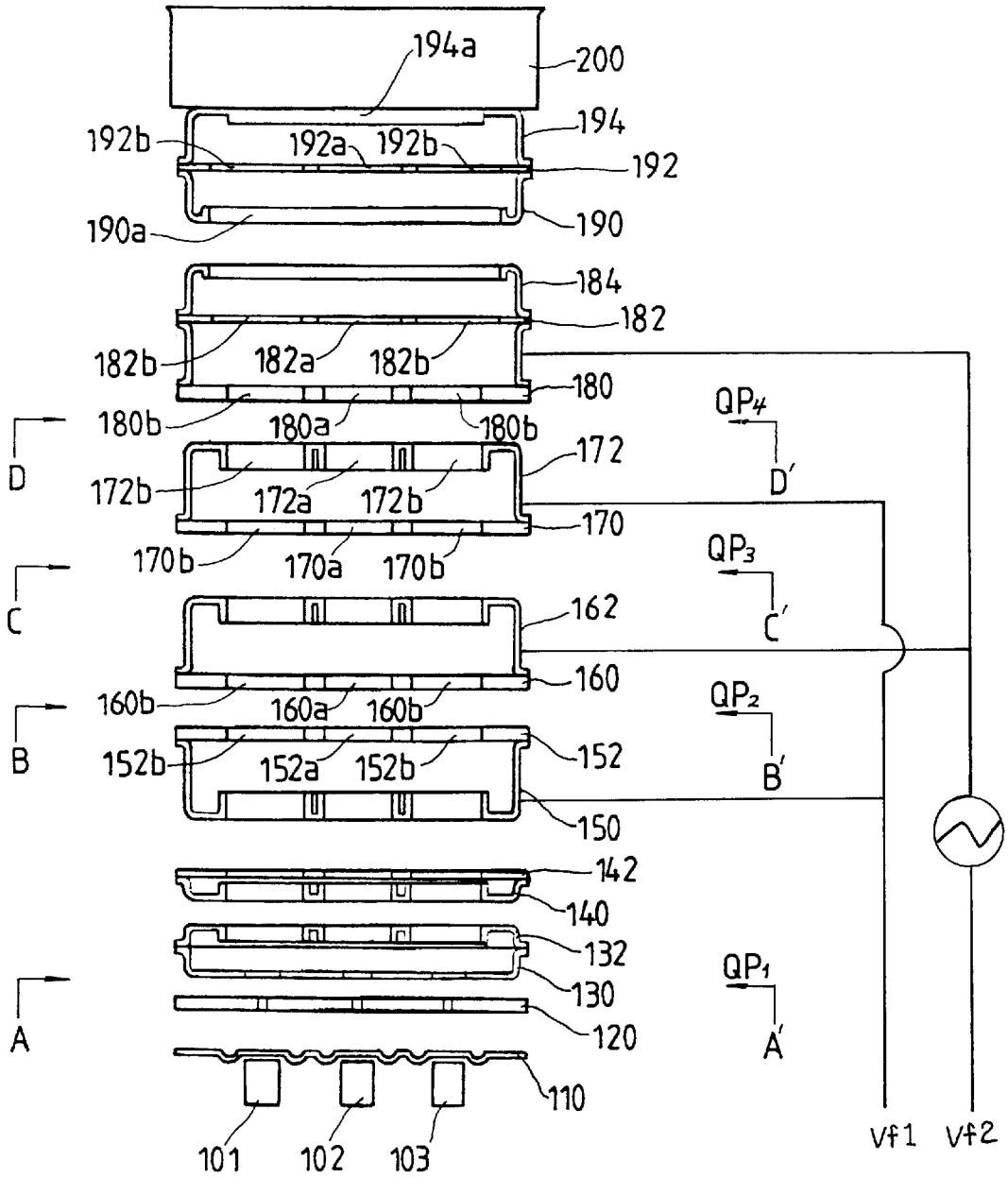
FIG. 3 is a sectional view of an in-line type electron gun according to an embodiment of the present invention.

FIG. 3 is a sectional view of an in-line type electron gun according to an embodiment of the present invention. As shown in FIG. 3, an improved electron gun structure according to the present invention comprises cathodes 101, 102 and 103 arranged in line and from which thermions are radiated, a first electrode 110 as a control electrode, a second electrode 120 as a screen electrode, third electrodes 130 and 132 as accelerating electrodes, a fourth electrode 140 as a screen electrode, first focusing electrodes 150 and 152, second focusing electrodes 160 and 162, a third focusing electrode 170, fourth focusing electrodes 180, 182 and 184, anode electrodes 190, 192 and 194 and a convergence cup 200. A static focusing voltage Vf1 is applied to the first focusing electrodes 150, 152 and the third focusing electrode 170, and a dynamic focusing voltage Vf2 (Vf2=Vf1=Vp: Vp is a parabola voltage) is applied to the second focusing electrodes 160, 162 and the fourth focusing electrodes 180, 182 and 184. The electrodes that the static focusing voltage Vf1 is applied to are arranged facing the electrodes the dynamic focusing voltage Vf2 is applied to, and, in order to decrease spherical aberrations by enlarging a main lens, rim electrodes 184, 190 are adapted.

FIGS. 4*a*–6*b* show various shapes of electron-beam-passing apertures of the second static electrode 152 and the second dynamic electrode 160 forming a second quadrupole lens QP2 taken along section line B–B' of FIG. 3. In this case, the static voltage Vf1 is applied to the second static electrodes 152, in opposition to which the dynamic voltage Vf2 is applied to the second dynamic electrode 160. When operating the second quadrupole lens QP2, a circular spot can be obtained at the center of the screen by compensating the intensity of the lens on the, horizontal axis differently from a third quadrupole lens, discussed below.

Furthermore, in order to control the enlarging of the beam spot on the horizontal axis, the horizontal and vertical size of the electron-beam-passing aperture 160*a* and 160*b* should be controlled. For this, a long burring may be formed into the inside of the electrode at each of an upper end and a lower end of a rectangular electron-beam-passing aperture in the present invention, a horizontal side of said rectangular electron-beam-passing aperture being longer than a vertical side thereof.

As a first preferable embodiment of the second quadrupole-lens-forming electrodes 152 and 160, each of three electron-beam-passing apertures of the second static electrode 152 of the second quadrupole-lens-forming electrodes 152 and 160 has a circular shape (not shown). A central electron-beam-passing aperture 160*a* of the second dynamic electrode 160 has a circular shape and each of the opposite side electron-beam-passing apertures 160*b*, 160*b* thereof has a substantially rectangular shape as shown in FIG. 4*b*.

As a second preferable embodiment of the second quadrupole-lens-forming electrodes 152 and 160, each of three electron-beam-passing apertures of the second static electrode 152 of the second quadrupole-lens-forming electrodes 152 and 160 has a circular shape. A central electron-beam-passing aperture 160*a* of the second dynamic electrode 160 has a circular shape and each of opposite side electron-beam-passing-apertures 160*b*, 160*b* thereof has a substantially rectangular shape, as in the first embodiment of the second quadrupole-lens-forming electrodes 152 and 160. Said second static electrode 152 and the second dynamic electrode 160 are formed into a plate-shaped electrode and each of an upper end and a lower end of each electron-beam-passing aperture has a burring portion formed into the inside of the second plate-shaped electrode 160.

Figure 4A:
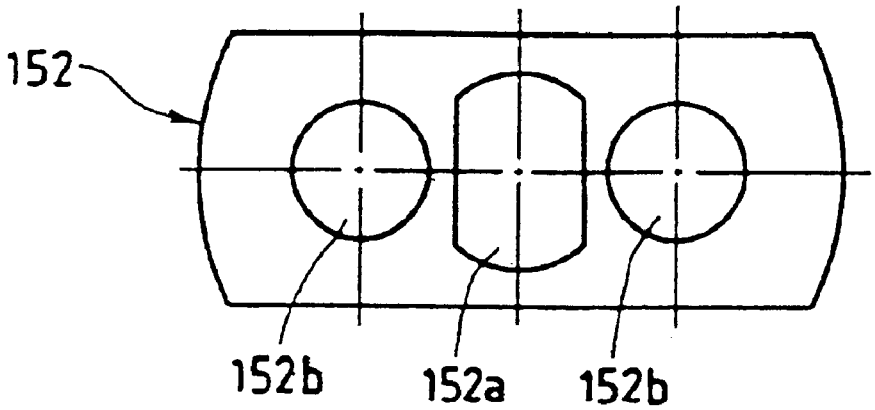
FIGS. 4*a*–6*b* are shape diagrams of electron-beam-passing apertures of a second static electrode and a second dynamic electrode forming a second quadrupole lens in section of line B–B' of FIG. 3.
Figure 4B:
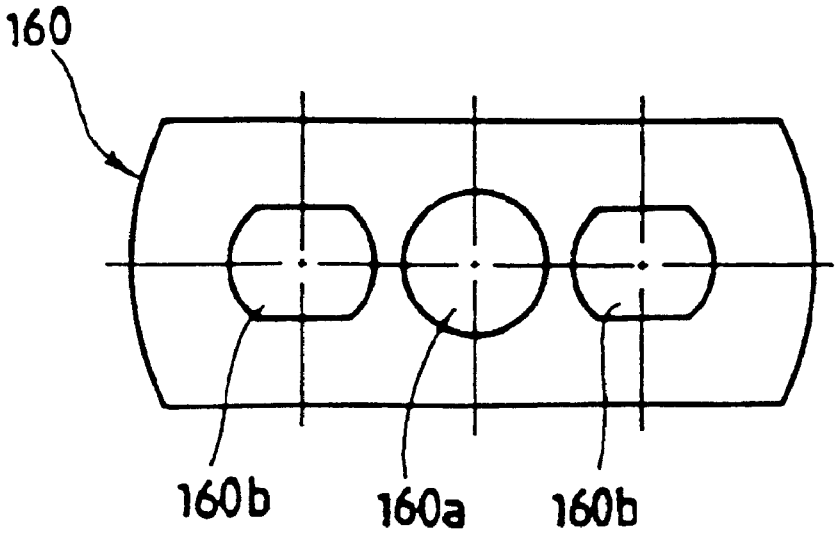

A third preferable embodiment of the second quadrupole-lens-forming electrodes 152 and 160 is shown in FIGS. 4*a* and 4*b*. As shown in FIGS. 4*a* and 4*b*, the central electron-beam-passing aperture 152*a* of the second static electrode 152 of the second quadrupole-lens-forming electrodes 152 and 160 has a larger size in the vertical direction than in the horizontal direction. Each of the opposite side electron-beam-passing apertures 152*b*, 152*b* has a circular shape.

Figure 5A:
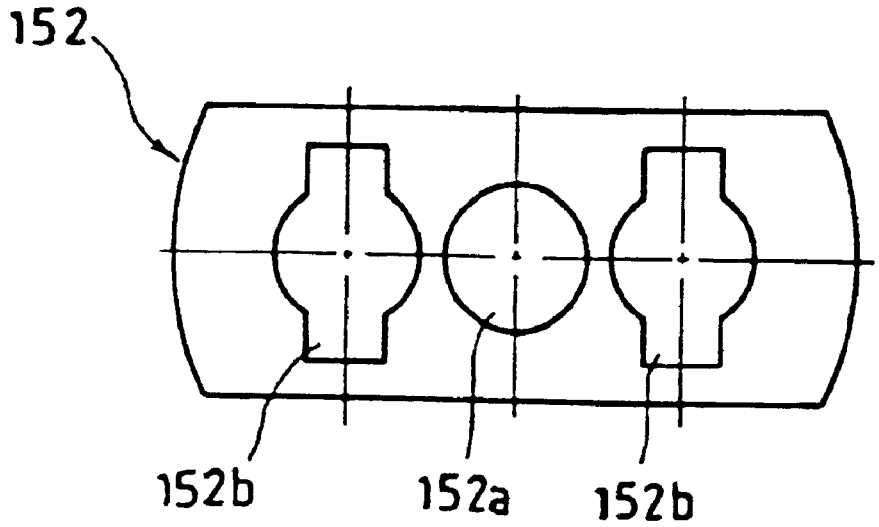
Figure 5B:
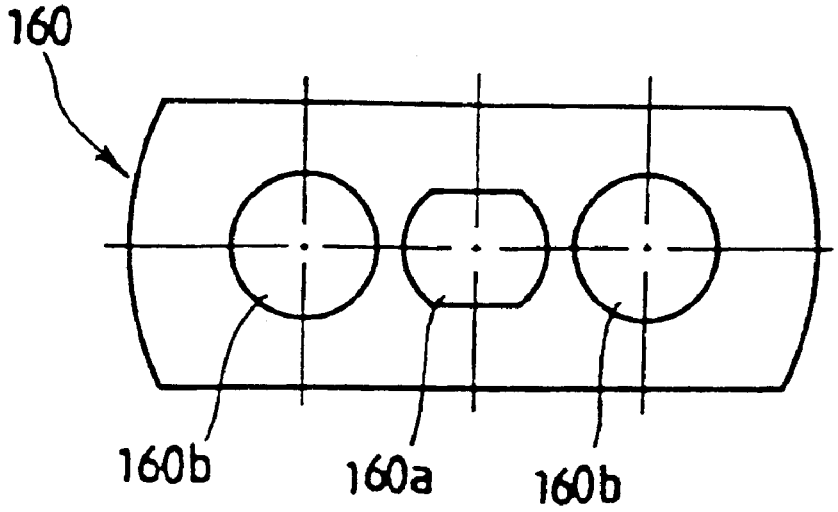

FIGS. 5*a* and 5*b* show a fourth embodiment of the second quadrupole-lens-forming electrodes 152 and 160, wherein each of the opposite side electron-beam-passing apertures 152*b* and 152*b* of the second static electrode 152 has a key-aperture shape. The central electron-beam-passing aperture 152*a* thereof has a circular shape, and each of the opposite side electron-beam-passing apertures 160*b* of the second dynamic electrode 160 has a circular shape. The central electron-beam-passing aperture 160*a* thereof has a larger size in the horizontal direction than in the vertical direction.

Figure 6A:
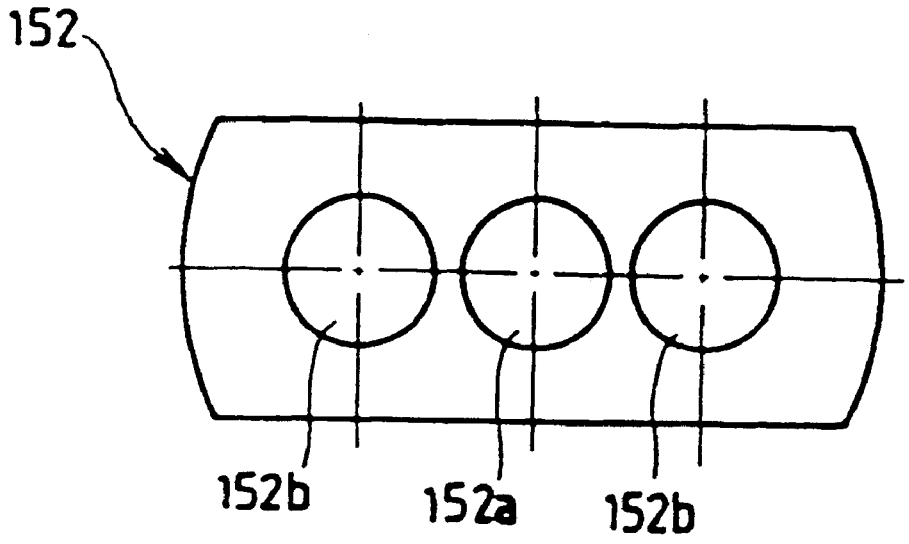
Figure 6B:
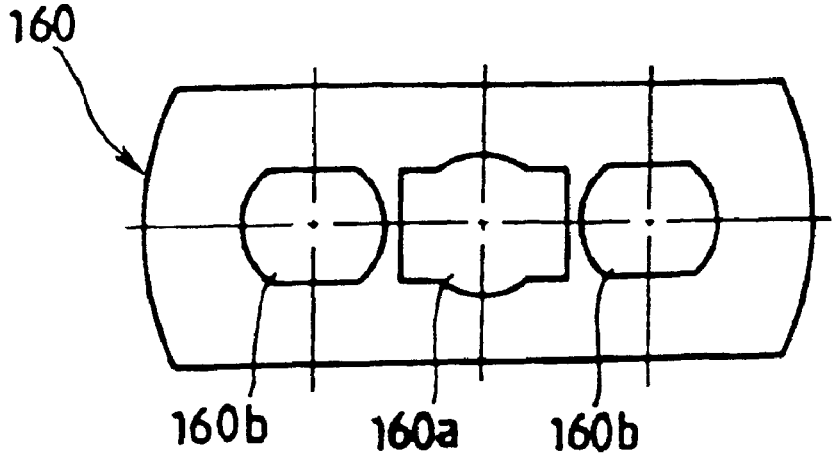

A fifth embodiment of the second quadrupole-lens-forming electrodes 152 and 160 is shown in FIGS. 6*a* and 6*b*. Each of three electron-beam-passing apertures of the second static electrode 152 has a circular shape, and each of three electron-beam-passing apertures 160*a* of the second dynamic electrode 160 has a larger size in the horizontal direction than in the vertical direction. Only the central electron-beam-passing aperture 160*a* thereof has a key-hole shape oriented in the horizontal direction.

As described above, the action of the dynamic focusing voltage Vf2 in the peripheral areas prevents the electron beam from lengthening. However, the dynamic focusing voltage Vf2 causes a remarkable difference between the incident angles of the horizontal electron beam and the vertical electron beam to the main lens, thereby making each focusing length different and creating a halo element in the peripheral areas. In order to compensate for such distortion of the electron beam, the ratio of the incident angles of the horizontal electron beam and the vertical electron beam to the main lens is minimized, and so that of the beam spots of the horizontal electron beam and the vertical electron beam can be minimized. The distortion of the electron beam is thereby minimized. In order to realize this characteristic, each of three electron-beam-passing apertures of a third dynamic electrode 162, to which the dynamic focusing voltage Vf2 is applied, is formed into a circle having a burring. Each of three electron-beam-passing apertures of a third static electrode 170, to which the static focusing voltage Vf1 is applied, is formed without a burring or with a burring smaller than in the third dynamic electrode 162.

Figure 7A:
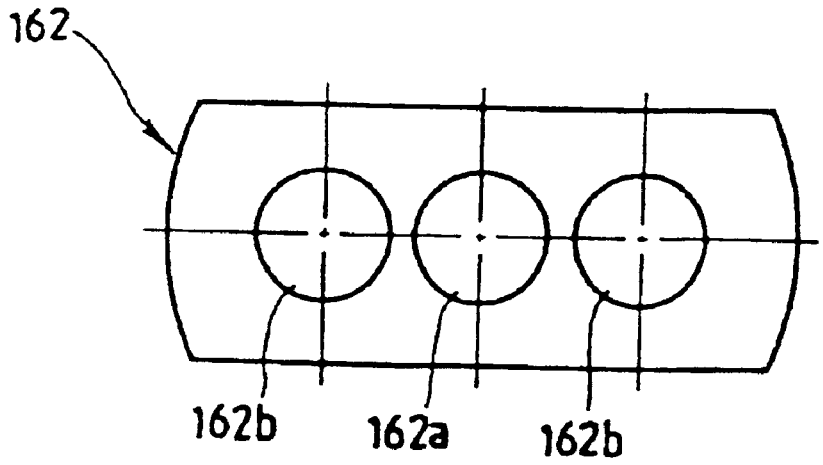
FIGS. 7*a*–7*b* are shape diagrams of electron-beam-passing apertures of a third static electrode and a third dynamic electrode forming a third quadrupole lens in section of line C–C' of FIG. 3.
Figure 7B:
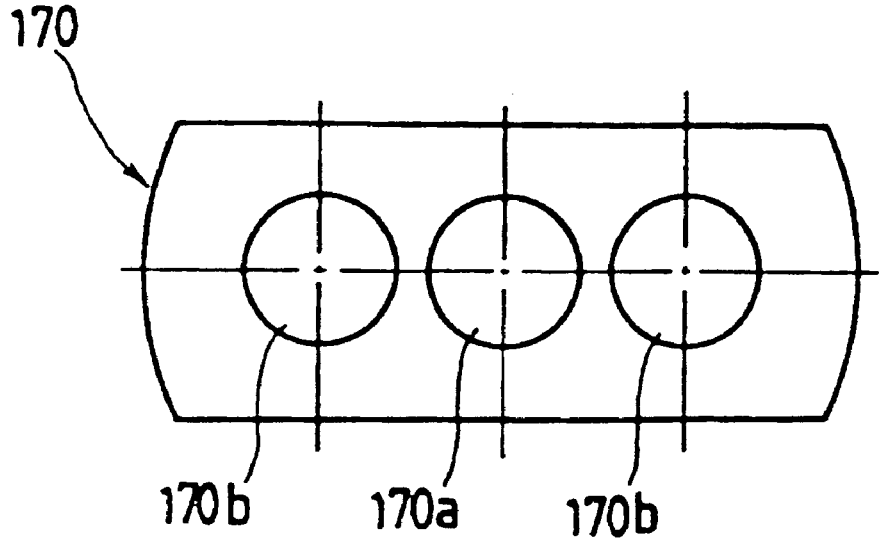

FIGS. 7*a* and 7*b* illustrate one preferable first embodiment of the shapes of electron-beam-passing apertures for the third static electrode 170 and the third dynamic electrode 162, together forming a third quadrupole lens QP3, taken along section line C–C' of FIG. 3. As shown in FIGS. 7*a* and 7*b*, each of the electron-beam-passing apertures 170*a*, 170*b*, 162*a* and 162*b* of the third static electrode 170 and the third dynamic electrode 162, respectively, has a circular shape.

As a second embodiment of the shapes of electron-beam-passing apertures of the third static electrode 170 and the third dynamic electrode 162 forming the third quadrupole lens QP3, each of three electron-beam-passing apertures 170*a*, 170*b* of the third static electrode 170 has a larger size in the vertical direction than in the horizontal direction, and each of three electron-beam-passing apertures 162*a*, 162*b* of the third dynamic electrode 162 has a larger size in the horizontal direction than in the vertical direction.

FIGS. 8*a*–11 illustrate various embodiments of electron-beam-passing apertures 172*a*, 172*b*, 180*a* and 180*b* of a fourth static electrode 172 and a fourth dynamic electrode 180, respectively, which together constitute a fourth quadrupole lens QP4. The electron-beam-passing-apertures 172*a* and 172*b* of the fourth static electrode 172 may have a larger size in the vertical direction than in the horizontal direction, or a circular shape, as a means for obtaining a longer spot in the longitudinal axis when a deflection magnetic field does not exist in the peripheral areas, and where the dynamic focusing voltage Vf2 is applied. And, the electron-beam-passing apertures 180*a* and 180*b* of the fourth dynamic electrode 180 have a dumbbell-shape or a key-hole shape so that the focusing force of the vertical beam can be stronger than that of the horizontal beam. This makes the quadrupole lens effect stronger and lowers the parabola voltage Vp.

Figure 8A:
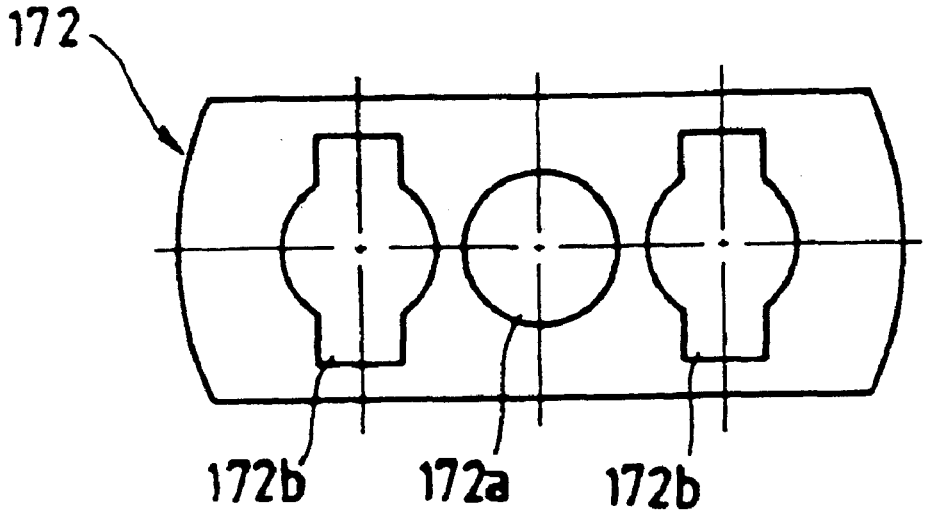
FIGS. 8*a*–8*b* are shape diagrams of electron-beam-passing apertures of a fourth static electrode constituting a fourth quadrupole lens in section of line D–D' of FIG. 3.

As shown in FIG. 8*a*, since the quadrupole lens effect of the center electron beam becomes weaker than that of the side electron beam when the center electron-beam-passing aperture 172*a* thereof has a key hole, the center electron-beam-passing aperture 172*a* of the fourth static electrode 172, to which the static focusing voltage Vf1 is applied; has a circular shape. Each of the opposite side electron-beam-passing apertures 172*b* has a shape longer in the vertical direction, thereby removing the difference in the dynamic focusing voltage Vf2 between the center electron beam and the opposite side electron beams.

Figure 8B:
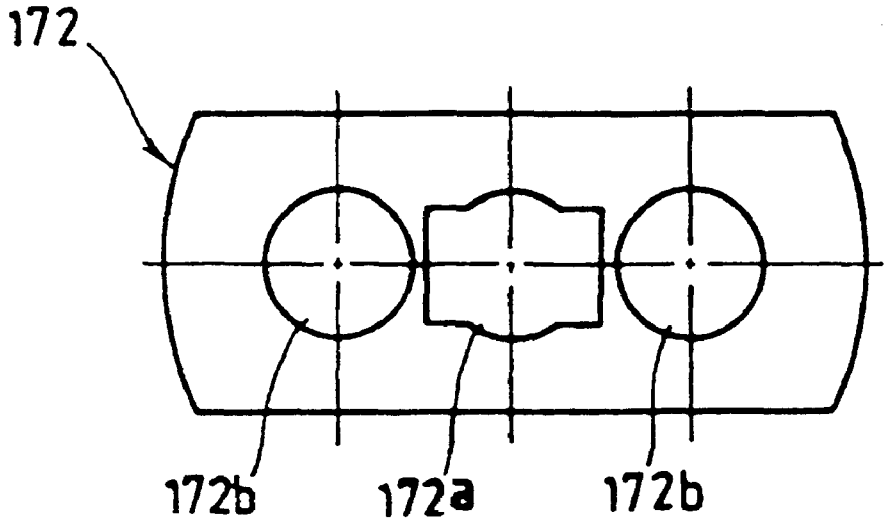

In FIG. 8*b*, the center electron-beam-passing aperture 172*a* of the fourth static electrode 172, having the static focusing voltage Vf1 applied thereto, has a shape longer in the horizontal direction. Each of the opposite side electron-beam-passing apertures 172*b* has a circular shape, thereby causing the same effect as described for the apertures 172*a*, 172*b* in FIG. 8*a*.

Figure 9:
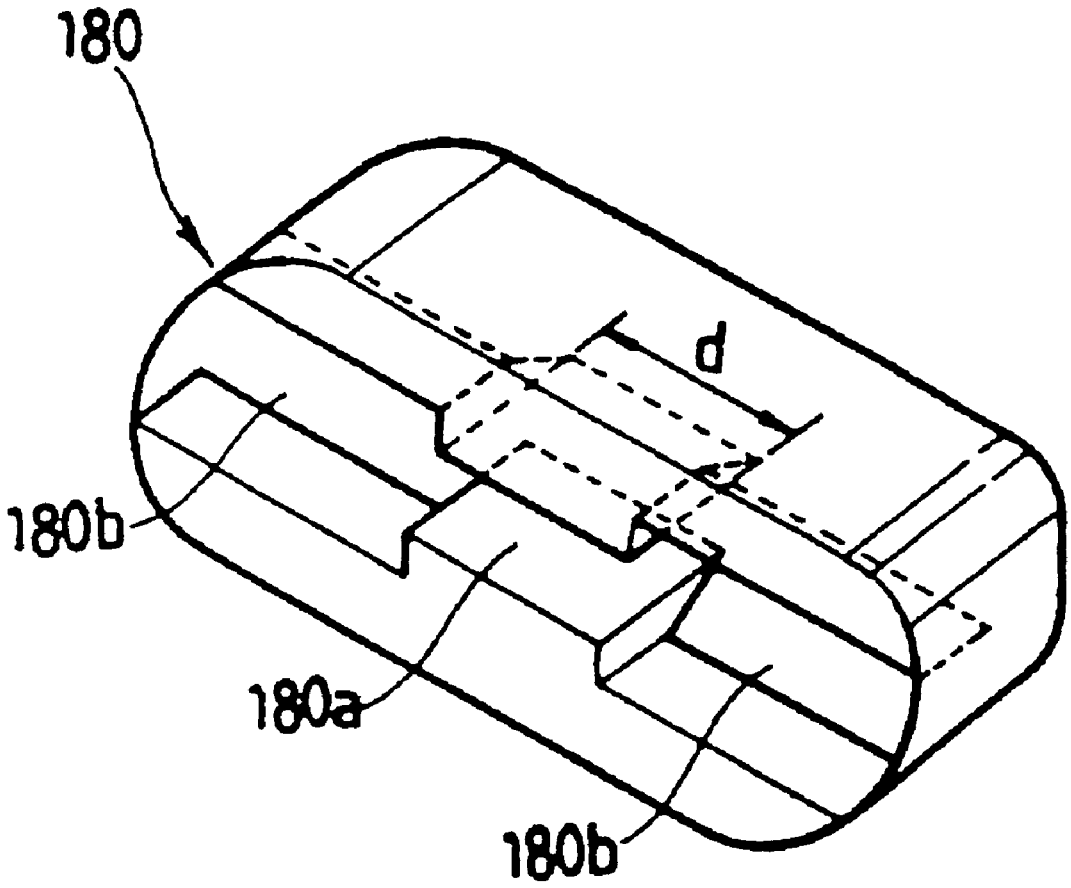
FIG. 9 is a schematic perspective view of one embodiment of a fourth dynamic electrode constituting a fourth quadrupole lens in section of line D–D' of FIG. 3.

FIG. 9 shows a schematic perspective view of one embodiment of the fourth dynamic electrode 180 constituting a fourth quadrupole lens QP4. Three electron-beam-passing apertures 180*a*, 180*b* thereof form a single key-hole having a dumbbell-shape that the three electron beams are passed through in common. The apertures 180*a*, 180*b* comprise burring portions formed into the inside of the electrode 180 at each of an upper end and a lower end thereof. The central electron beam passes through the electrode 180 within a constant distance d from the center of the burring portion in width, while each of the opposite side electron beams passes through at each of opposite outsides of the constant distance d. In this embodiment, the length of the burring portion of the central electron-beam-passing aperture 180*a* becomes longer than the length of the burring portion of each of the opposite side electron-beam-passing apertures 180*b*. Accordingly, when the dynamic focusing voltage Vf2 is applied, the intensity of the lens in the vertical axis becomes stronger, thereby minimizing the contracting phenomena of the horizontal electron beam. Also, the center electron-beam-passing aperture 180*a* is enlarged, thereby enabling the core of the spot to become enlarged.

Figure 10A:
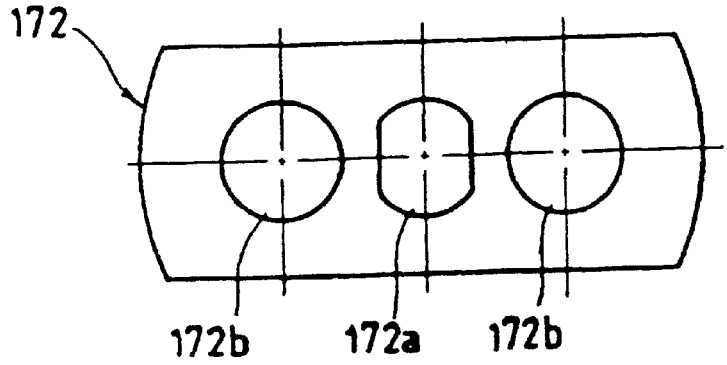
FIGS. 10*a*–10*c* are shape diagrams of electron-beam-passing apertures of a fourth static electrode constituting a fourth quadrupole lens in section of line D–D' of FIG. 3.
Figure 10B:
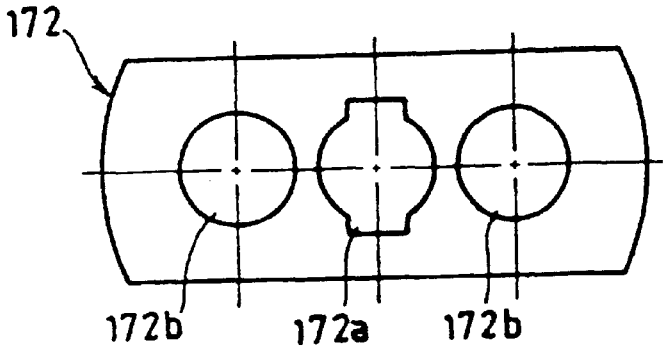
Figure 10C:
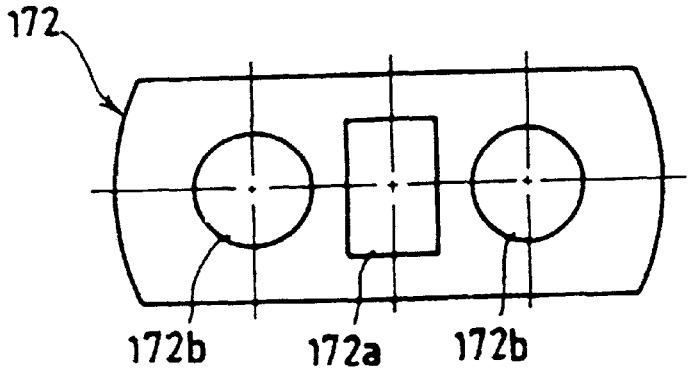

FIGS. 10*a* to 10*c* illustrate various embodiments of the electron-beam-passing-apertures 172*a* and 172*b* of the fourth static electrode 172. In FIG. 10*a*, the center electron-beam-passing aperture 172*a* has an enlarged circular shape in the vertical direction, and each of the side electron-beam-passing apertures 172*b* has a circular shape. In FIG. 10*b*, the center electron-beam-passing aperture 172*a* has a key-hole shape, while in FIG. 10*c*, it is a rectangular shape enlarged in the vertical direction.

Figure 11:
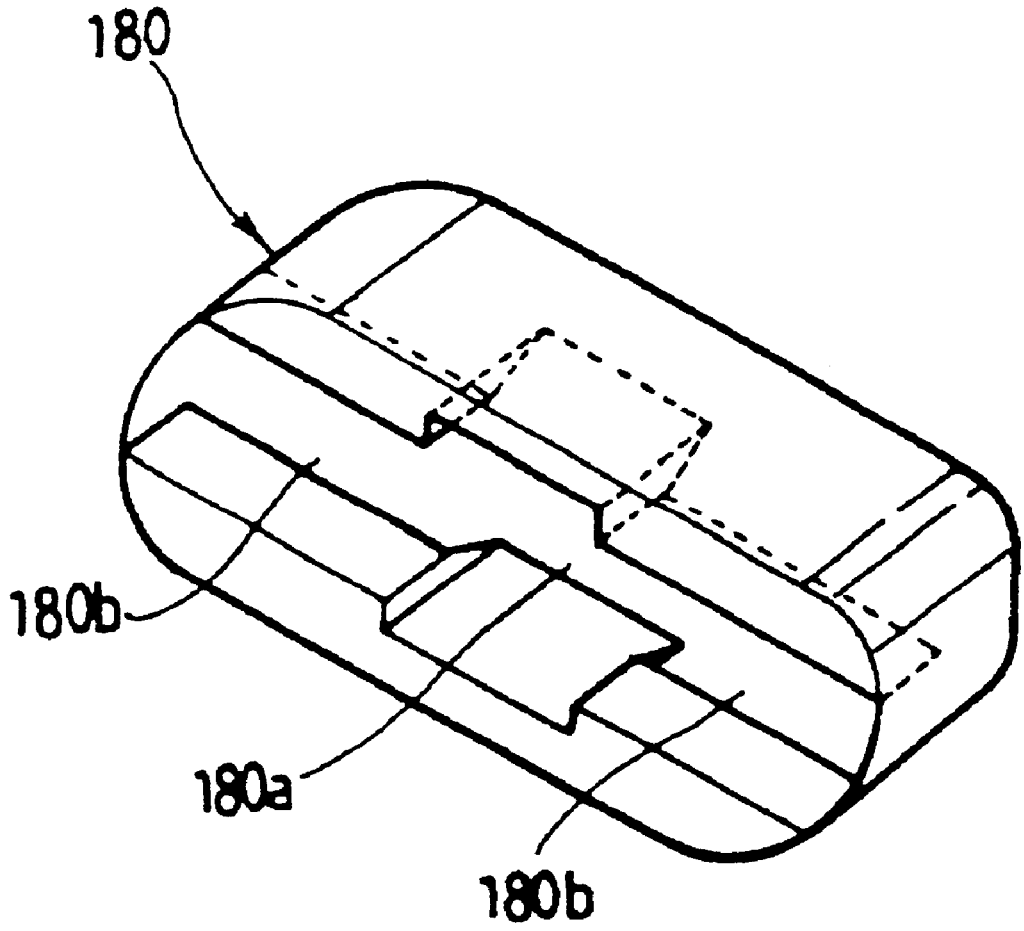
FIG. 11 is a diagrammatic perspective view of another embodiment of a fourth dynamic electrode constituting a fourth quadrupole lens in section of line D–D' of FIG. 3.

FIG. 11 shows a second embodiment of the fourth dynamic electrode for compensating for reducing of the horizontal size of the center electron beam due to the application of the dynamic focusing voltage Vf2. As shown in FIG. 11, three electron-beam-passing apertures 180*a*, 180*b* thereof constitute a single key-hole which the three electron beams are passed through in common and comprises burring portions formed into the inside of the electrode 180 at each of an upper end and a lower end thereof. The height of the electron-beam-passing aperture in the center is higher than that in the opposite sides, which is different from that in the first embodiment. The central electron beam passes through within the constant distance d from the center of the burring portion in width, while each of the opposite side electron beams passes through at each of opposite outsides of the constant distance d. In this embodiment, the length of the burring portion of the central electron-beam-passing aperture 180*a* becomes longer than the length of the burring portion of each of the opposite side electron-beam-passing apertures 180*b*. Accordingly, when the dynamic focusing voltage Vf2 is applied, the intensity of the lens in the vertical axis becomes stronger, thereby enabling the contracting phenomena of the horizontal electron beam to be minimized.

Furthermore, an outer face of the center electron-beam-passing aperture 180*a* of the fourth dynamic electrode 180 near to a wall of an outer tube thereof coincides with an inner face of the side electron-beam-passing-aperture 180*b* thereof, near to the central electron-beam-passing aperture 180*a*, thereby providing the above-mentioned effect.

The above-mentioned improvement is used with a color cathode ray tube of more than 17 inch size, resulting in a static focusing voltage Vf1 and dynamic focusing voltage Vf2 as shown in the following table:

| | CONVENTIONAL ELECTRON GUN | PRESENT ELECTRON GUN |
|---|---|---|
| CENTER OF SCREEN Vf1(kV): | 7.4 | 7.20 |
| PERIPHERY Vf2(kV): | 7.9 | 7.5 |
| PARABOLA VOLTAGE(kV): | 0.5 | 0.3 |

Figure 12A:
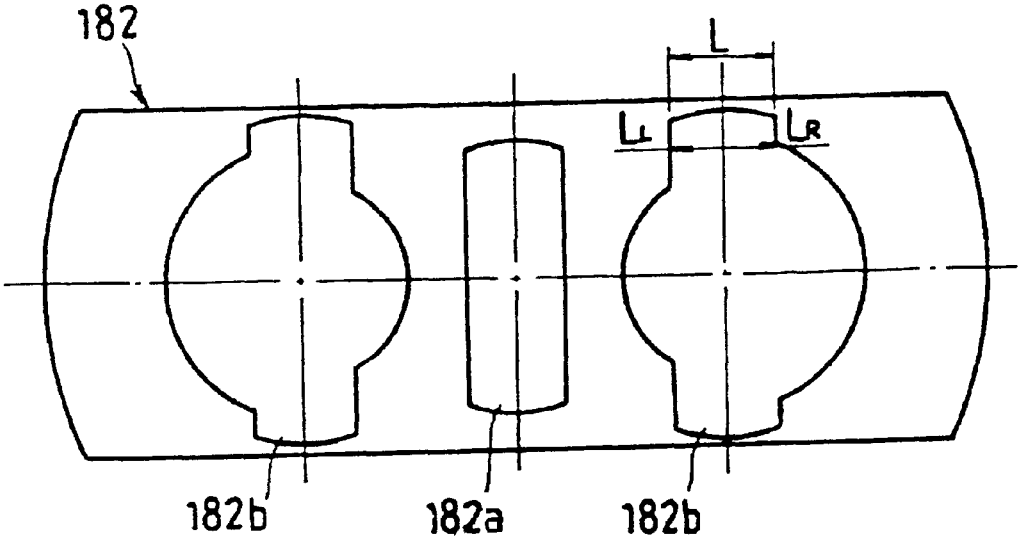
FIGS. 12*a*–12*b* are sectional views of a electrode having electron-beam-passing apertures in electrodes constituting a main lens.
Figure 12B:
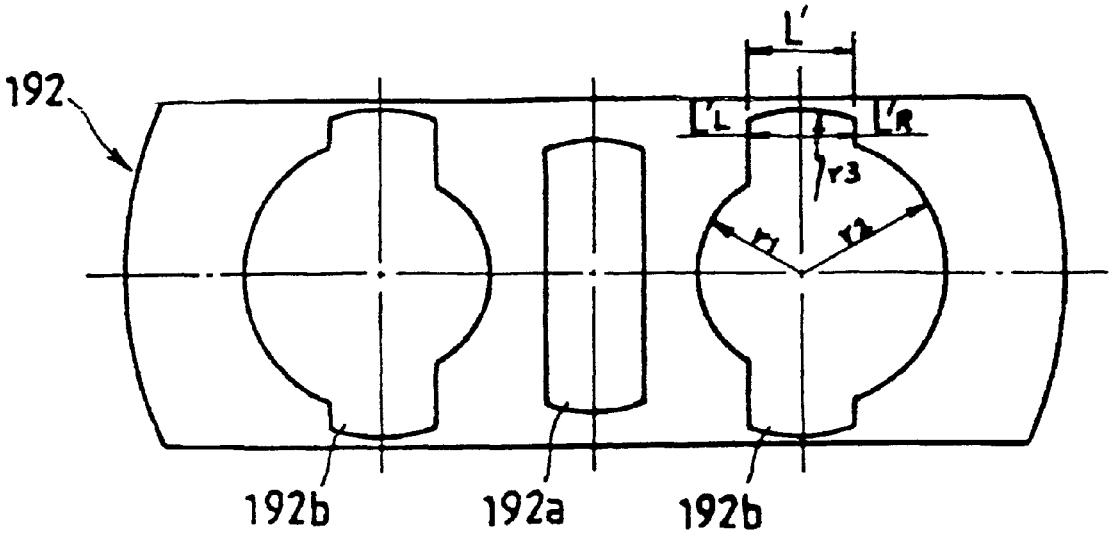

FIGS. 12*a* and 12*b* show electrodes 182 and 192 having one embodiment of electron-beam-passing apertures in electrodes 184 and 190 constituting a main lens as a vertical section view.

The electrodes of the portion constituting the main lens adopt a rim electrode, thereby having an enlarged lens. As shown in FIGS. 12*a* and 12*b*, each of opposite side electron-beam-passing apertures 182*b*, 192*b*, respectively, is formed as an asymmetric key-hole in the opening shape.

As a second embodiment of the electron-beam-passing apertures in the electrodes 184 and 190, an inner opening size of the opposite side electron-beam-passing apertures 182*b*, 192*b* near to the central electron-beam-passing apertures 182*a*, 192*a* is larger than an outer opening size of the opposite side electron-beam-passing apertures 182*b*, 192*b* near to a wall of an outer tube of the electrodes 182, 192.

A third embodiment of the electron-beam-passing apertures in the electrodes 184 and 190 constituting the main lens is that the asymmetric key-hole is formed by three different radii r1, r2, r3.

In a fourth embodiment of the electron-beam-passing apertures of the electrodes 182 and 192 in the electrodes 184 and 190 constituting the main lens, each center of the three different radii r1, r2, r3 for forming the asymmetric key-hole may be identical or different.

As described above, the outer opening size of the opposite side electron-beam-passing apertures 182*b*, 192*b* near to the wall of the outer tube of the electrodes 182, 192 is enlarged as the asymmetric key-hole, and a side wall effect of the electrodes is minimized, thereby enabling the improvement of the beam spot.

Figure 13:
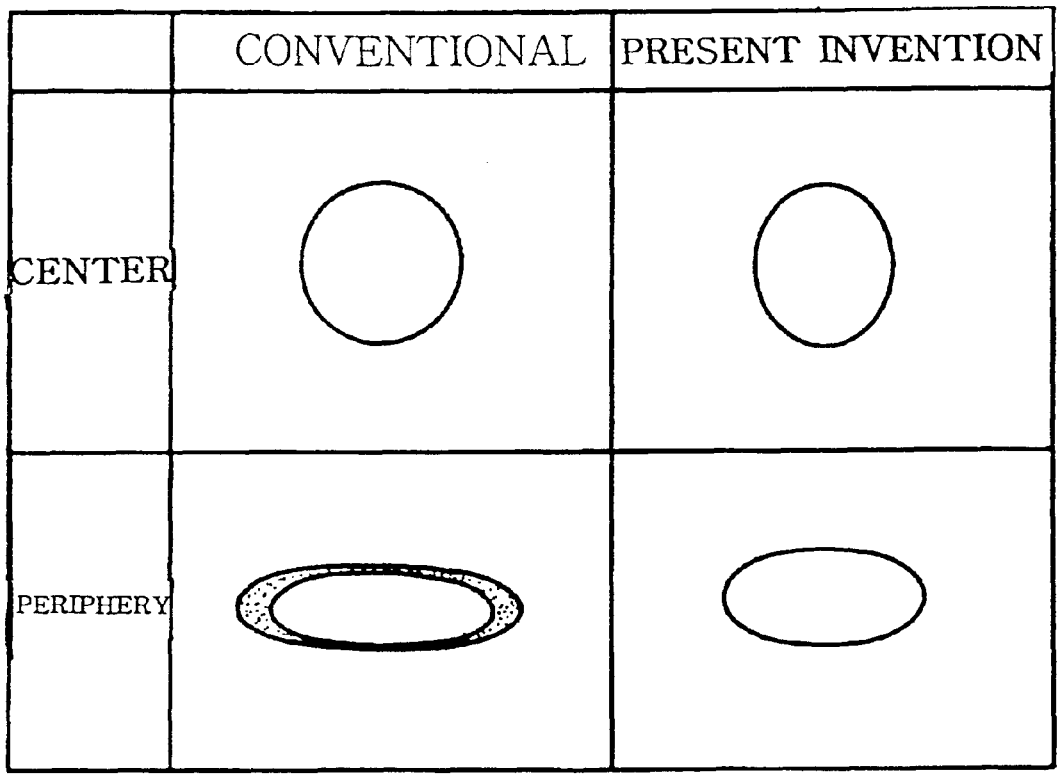
FIG. 13 is a graph for comparing sizes of beam spots of a center portion and a periphery of the screen in the electron gun of the present invention with those in the conventional electron gun.

FIG. 13 illustrates the result of the improvement. In FIG. 13, when the ratio of the horizontal size to the vertical size of the beam spot in the center of the screen is 1:1.1, the ratio of the horizontal size to the vertical size of the beam spot in the peripheral areas of the screen becomes 1.3:1, which is one of the preferable spot size ratios. From this data, it will be understood that an improvement effect of around 65% can be obtained.

In forming the opening which the side beam passes through, the length of the spot on the horizontal axis changes according to the length L of the upper horizontal portion of the asymmetric key-hole in the electrode 182 as shown in FIG. 12*a*. Similarly, the length of the spot on the horizontal axis changes according to the length L' of the upper horizontal portion of the asymmetric key-hole in the electrode 192, as shown in FIG. 12*b*.

In a first embodiment, the lengths L and L' of the asymmetric key-holes of the confronting plate electrodes 182 and 192 may be identical or different.

In a second embodiment of the confronting plate electrodes 182 and 192 constituting the main lens, for forming the opening shape of the electron-beam-passing apertures, each distance LL and LR from the center of the asymmetric key-hole of the plate electrodes 182 may be identical or different. Also, each distance L'L and L'R from the center of the asymmetric key-hole of the plate electrodes 192 may be identical or different.

Figure 14:
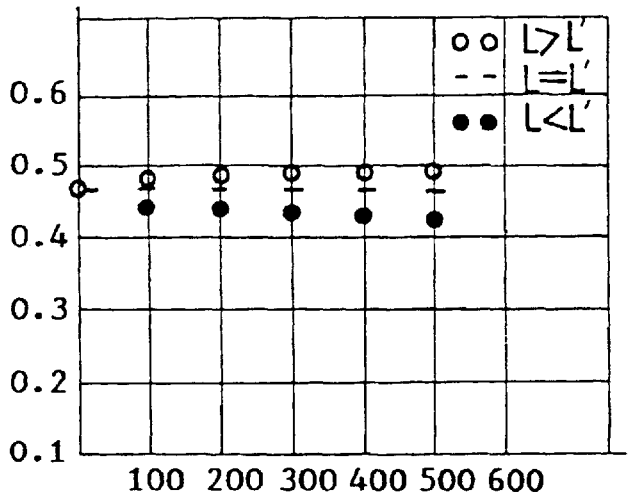
FIG. 14 is a graph for showing the change in the size of the beam spot according to the change in the upper horizontal length of electron-beam-passing apertures.

That is, when L' is smaller than L in the main lens, the horizontal main lens portion formed at the electrodes 182 and 184, to which the dynamic focusing voltage Vf2 is applied, is enlarged, and so the spot. size becomes satisfactory. Therefore, the spot shape can be easily controlled by simply changing the size of the values of L and L', which is an advantage provided by the present invention. FIG. 14 shows the change of the spot resulting from the change of the sizes L and L'.

Figure 15:
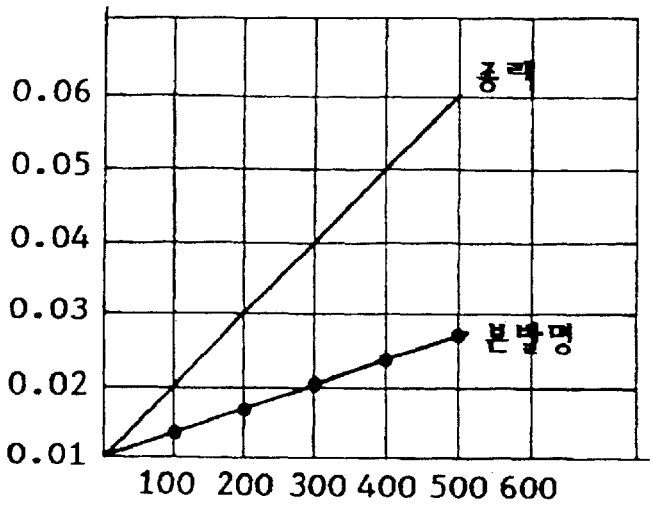
FIG. 15 is a graph for showing the change of the convergence according to the change of a focusing voltage in an electron gun according to the present invention.

FIG. 15 shows the change of the convergence corresponding to a change of the dynamic focusing voltage Vf2. When the dynamic focusing voltage Vf2 is 600 V, it is indicated that the effect in the present invention is around three times as in the conventional electron gun. In the present invention, in order to minimize the convergence change when the dynamic focusing voltage Vf2 is applied, the opposite side electron-beam-passing apertures among the three electron-beam-passing apertures of the static electrode 172, which is opposite to a dynamic electrode in the strong quadrupole lens forming electrodes of line D—D and the focusing voltage Vf1 is applied to, is offset from the basic pitch. And, the size of the opposite side electron-beam-passing apertures is.increased by the offset axial distance. Thus, when the dynamic voltage Vf2 is applied, the deflection angle is corrected and the change in the convergence is minimized.

According to the present invention as described above, there is provided an electron gun for a cathode ray tube, further comprising three independent static electrodes having the static focusing voltage Vf1 applied thereto, and three independent electrodes to which the dynamic focusing voltage Vf2 is applied and they are arranged confronting each of the three independent static electrodes, thereby resulting in a strong quadrupole lens effect when a modulated voltage is applied. Also, while enlarging electron-beam-passing apertures in electrodes of a main lens, the opposite side electron-beam-passing apertures of the electron beams R and B among the three electron-beam-passing apertures of the static electrode 172 opposite to the dynamic electrodes 180, 182 and 184 in the strong quadrupole-lens-forming electrodes of line QF4 is offset towards a minus side. The size of the opposite side electron-beam-passing apertures is increased by the offset distance, thus minimizing a change in the convergence and spherical aberrations when a modulated voltage is applied, thereby improving resolution characteristics in the peripheral areas of a screen as well as convergence characteristics.

While the present invention has been particularly shown and described with reference to the particular embodiments thereof, it will be understood by those skilled in the art that various changes in form and details may be effected therein without departing from the spirit and scope of the invention as defined by the appended claims.

What is claimed is:

1. A color cathode ray tube, having an improved electron gun structure comprising a first electrode, a second electrode, a third electrode, a fourth electrode, anode electrodes and a convergence cup for focusing three electron beams radiated from cathodes arranged in line, said electron gun further comprising:

second quadrupole-lens-forming electrodes consisting of a second static electrode having a static voltage is applied thereto, and a second dynamic electrode disposed opposite the second static electrode and having a dynamic voltage applied thereto;

third quadrupole-lens-forming electrodes consisting of a third static electrode to which a static voltage is applied, and a third dynamic electrode disposed opposite the third static electrode and having a dynamic voltage applied thereto;

fourth quadrupole-lens-forming electrodes consisting of a fourth static electrode to which a static voltage is applied, and a fourth dynamic electrode which is disposed opposite to the fourth static electrode and having a dynamic voltage applied thereto; and a dumbbell-shaped key-hole aperture of the fourth dynamic electrode through which the three electron beams are passed in common, the key-hole aperture comprising a central dynamic electron-beam-passing aperture and a pair of side dynamic electron-beam-passing apertures together forming a single dumbbell-shaped opening, a burring portion formed inside of the fourth dynamic electrode at each of an upper end and a lower end thereof, a central electron beam of the three electron beams passing through the key-hole within a constant distance from the center of the burring portion in width, each of side electron beams passing through at each of opposite outsides of the constant distance, and the length of the burring portion of the central electron-beam-passing aperture being longer than the length of the burring portion of each of the side dynamic electron-beam-passing apertures.

* * * * *